US009298160B1

(12) United States Patent
Ogiwara et al.

(10) Patent No.: US 9,298,160 B1
(45) Date of Patent: Mar. 29, 2016

(54) IMAGE FORMING APPARATUS AND COOLING CONTROL METHOD FOR IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Takashi Ogiwara, Shizuoka (JP); Tadao Kamano, Shizuoka (JP); Yoshifumi Hasebe, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/723,716

(22) Filed: May 28, 2015

(51) Int. Cl.
*G03G 15/20* (2006.01)
*G03G 21/20* (2006.01)

(52) U.S. Cl.
CPC ..... *G03G 21/206* (2013.01)

(58) Field of Classification Search
CPC ..... G03G 21/206
USPC ..... 399/69, 92
See application file for complete search history.

(56) References Cited

U.S. PATENT DOCUMENTS

2003/0219274 A1* 11/2003 Hirose et al. ..... 399/92
2014/0056608 A1* 2/2014 Miura ..... 399/92

* cited by examiner

*Primary Examiner* — Hoang Ngo
(74) *Attorney, Agent, or Firm* — Amin, Turocy & Watson, LLP

(57) ABSTRACT

An image forming apparatus of an embodiment has a printer portion, a fan motor, a counter, a timer, and a control unit. The control unit calculates a time interval between print jobs from the difference between a printing completion time of a first print job and a printing start time of a second print job based on the value which is measured by the timer when the print jobs are continuously performed. Furthermore, the control unit starts driving of the fan motor when the operation time of the printer portion which is counted by the counter or a value replaced with the operation time of the printer portion is greater than or equal to a second threshold value.

10 Claims, 8 Drawing Sheets

FIG. 6

| SHEET | COUNT VALUE (/SHEET) | PRINTING SPEED (SHEETS/MINUTE) |
|---|---|---|
| A4 | 1 | 50 |
| B5 | 1 | 50 |
| A5-R | 1.67 | 30 |
| A4-R | 1.39 | 36 |
| B4 | 1.72 | 29 |
| A3 | 2 | 25 |

IMAGE FORMING APPARATUS AND COOLING CONTROL METHOD FOR IMAGE FORMING APPARATUS

FIELD

Embodiments described herein relate generally to an image forming apparatus and a cooling control method for an image forming apparatus.

BACKGROUND

There is an image forming apparatus which forms a visible image (toner image) on an image carrier. The image forming apparatus has various motors, various electric circuits, and a heater (hereinafter, referred to as a heating component). The heating component of the image forming apparatus shares apart of an image forming operation when a current is applied.

The amount of heat generated from the heating component of the image forming apparatus varies in accordance with an operation load. The amount of heat generated from the heating component of the image forming apparatus in an image forming mode becomes greater than that in a standby mode and a sleep mode of the image forming apparatus. In the image forming mode, the larger the number of continuous prints is, the higher the temperature of the heating component of the image forming apparatus is. Each heating component has an allowable temperature for operating normally. Components other than the heating component of the image forming apparatus also have an allowable temperature based on heat resistance of the components or dimensional stability of the components.

The image forming apparatus has cooling fans in order to use each component within an allowable temperature range. The cooling fans include an air blowing fan which supplies low-temperature air to the inside of the apparatus, and an air discharge fan which discharges heated air from the apparatus. The air blowing fan blows air toward the heating component.

In the image forming apparatus in the related art, the cooling fans are turned on and off in each operation mode. In the sleep mode, all of the cooling fans are stopped. In the standby mode, the cooling fan excluding the air discharge fan is stopped. In the image forming mode, all of the cooling fans are driven. For example, in the image forming mode, a CPU drives the cooling fans even in the temperature environment in which there is room for the allowable temperature when starting an operation or the like. Each of the cooling fans is designed such that the temperature thereof does not exceed the allowable temperature of each component even if the amount of heat generated from each heating component becomes maximum.

For this reason, power consumption is increased due to the rotation of the cooling fans particularly in the image forming mode. Furthermore, noise is increased due to the rotation of the cooling fans.

DESCRIPTION OF THE DRAWINGS

FIG. 6 is a table showing an example of a counter value of a counter of the apparatus.

DETAILED DESCRIPTION

Figure 1:
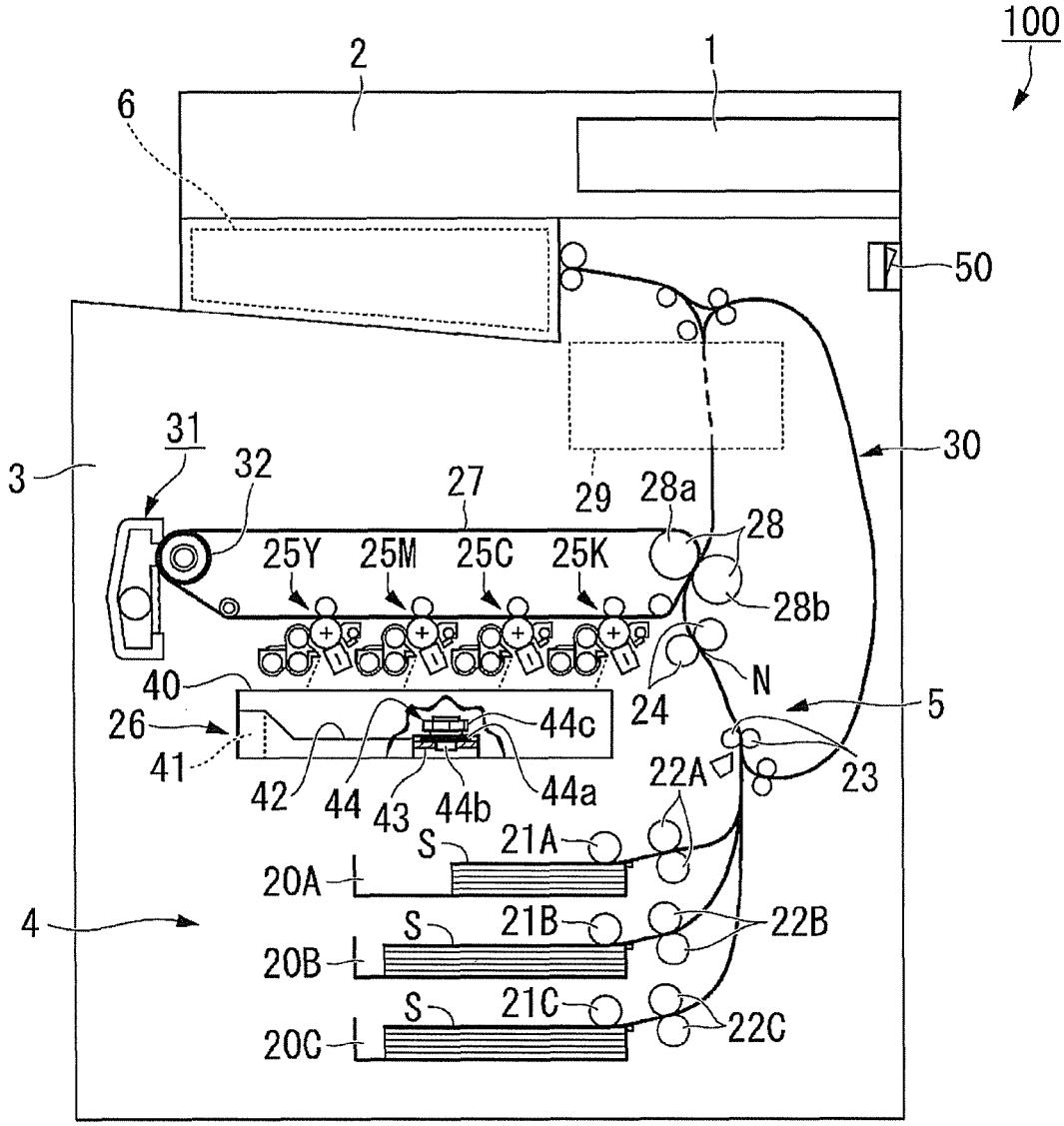
FIG. 1 is a schematic view of a cross section showing an overall configuration example of an image forming apparatus of an embodiment.

The image forming apparatus of an embodiment has a printer portion, a fan motor, a counter, a timer, and a control unit. The printer portion forms an image on a sheet based on an input print job. The counter counts an operation time of the printer portion or a value which is replaced with the operation time of the printer portion. The timer measures a printing start time and a printing completion time based on the print job. The control unit controls the fan motor. The control unit calculates a time interval between print jobs from the difference between a printing completion time of a first print job and a printing start time of a second print job based on the value which is measured by the timer when the print jobs are continuously performed. Furthermore, the control unit resets the counter when the time interval exceeds a first threshold value. Furthermore, the control unit starts driving of the fan motor when the operation time of the printer portion which is counted by the counter or the value replaced with the operation time of the printer portion is greater than or equal to a second threshold value.

Embodiment

Hereinafter, an image forming apparatus 100 of the embodiment will be described with respect to accompanying drawings. The same configuration in each drawing will be given the same reference numerals.

Figure 2:
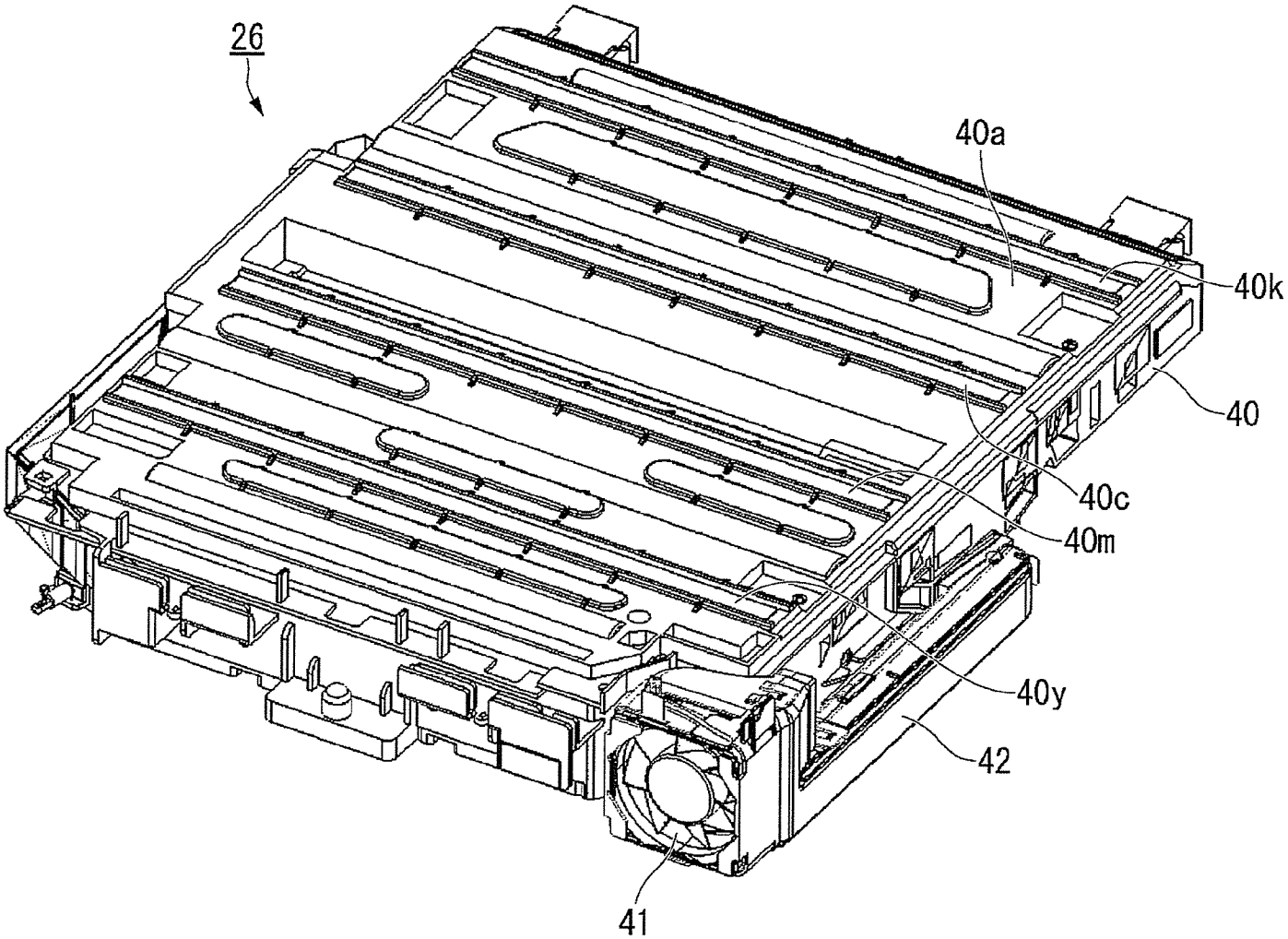
FIG. 2 is a perspective schematic view showing a configuration example of a laser scanning unit.
Figure 3:
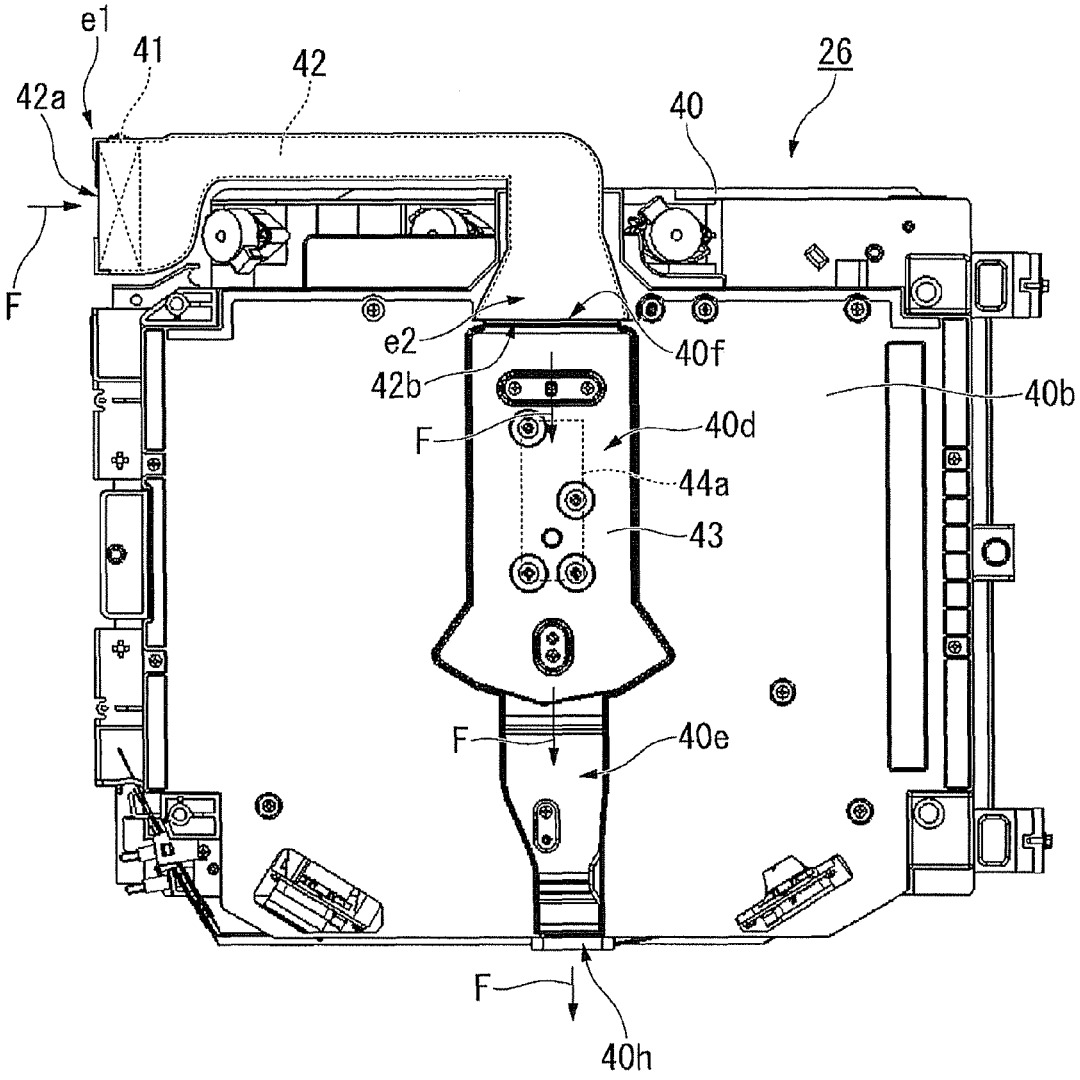
FIG. 3 is a schematic view of a rear face showing a configuration example of the laser scanning unit.
Figure 4:
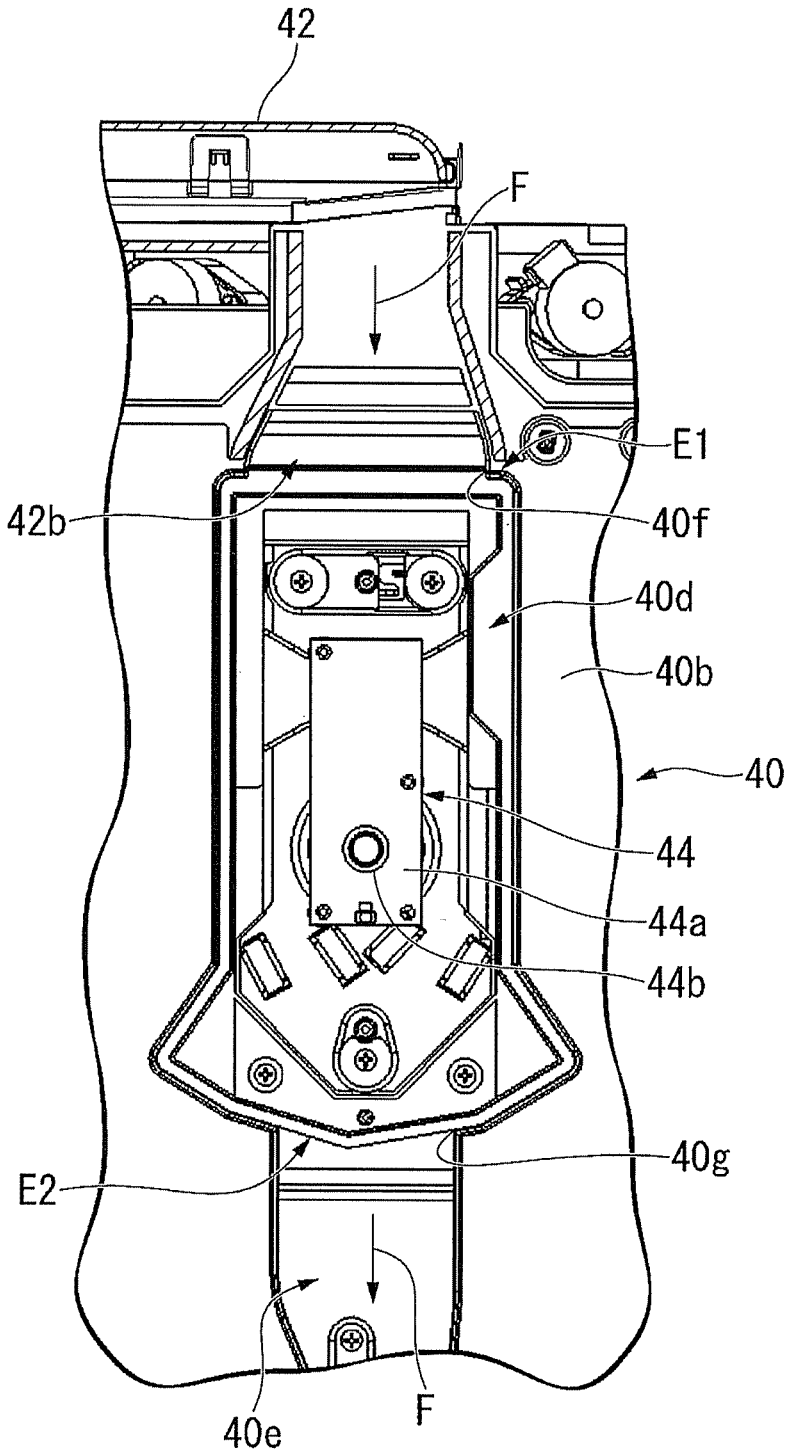
FIG. 4 is a schematic view of a rear face showing an attachment portion of a polygon motor of the laser scanning unit.
Figure 5:
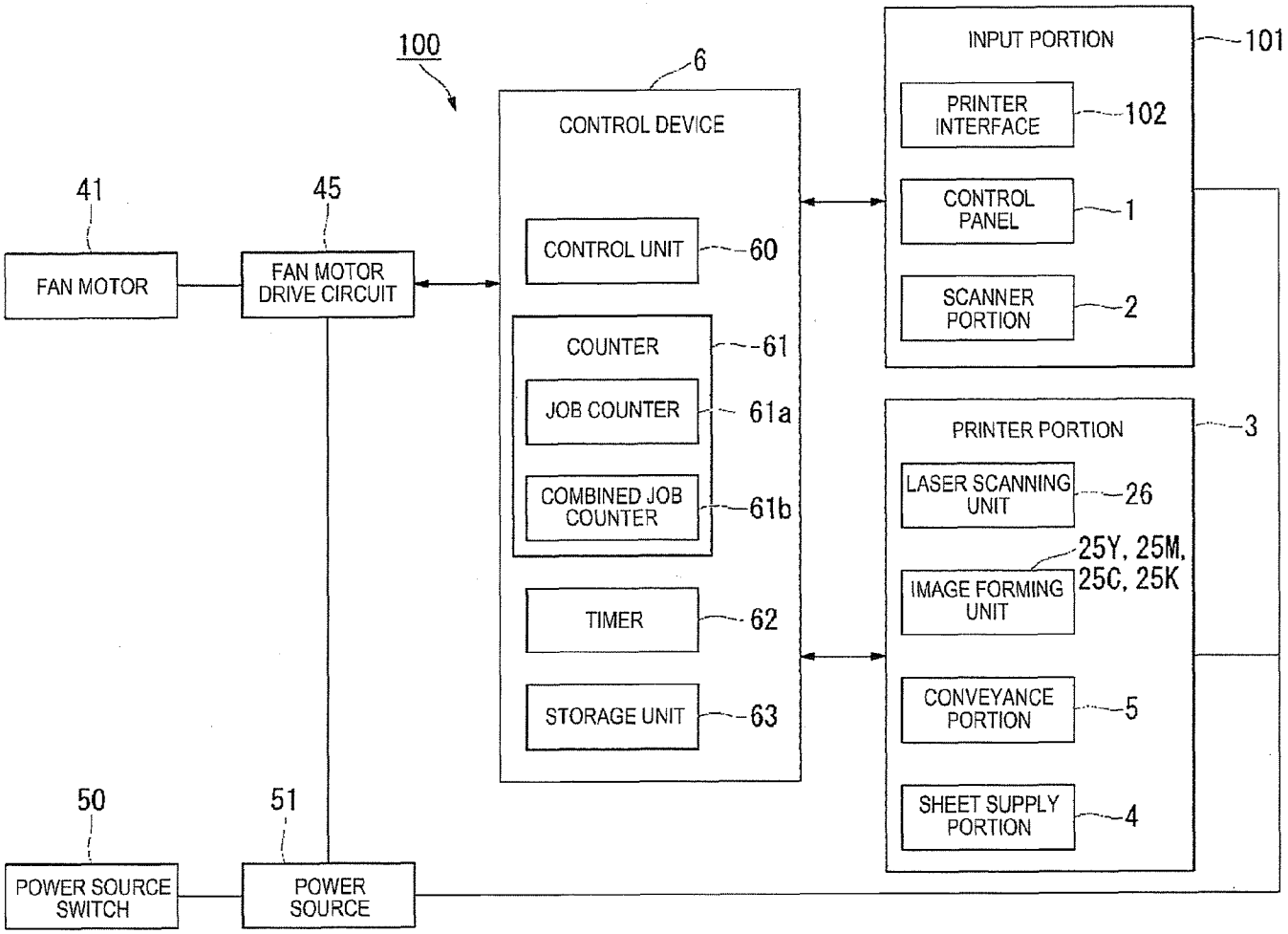
FIG. 5 is a block diagram showing a functional configuration example of the apparatus.

FIG. 1 is a schematic view of a cross section showing an overall configuration example of the image forming apparatus 100 of the embodiment. FIG. 2 is a perspective schematic view showing a configuration example of a laser scanning unit 26 of the image forming apparatus 100 of the embodiment. FIG. 3 is a schematic view of a rear face showing a configuration example of the laser scanning unit 26 of the image forming apparatus 100 of the embodiment. FIG. 4 is a schematic view of a rear face showing an attachment portion of a polygon motor 44 of the laser scanning unit 26 of the image forming apparatus 100 of the embodiment. FIG. 5 is a block diagram showing a functional configuration example of the image forming apparatus 100 of the embodiment. FIG. 6 is a table showing an example of a counter value of a counter 61 of the image forming apparatus 100 of the embodiment.

As shown in FIG. 1, the image forming apparatus 100 of the embodiment has a control panel 1, a scanner portion 2, a printer portion 3, a sheet supply portion 4, a conveyance portion 5, and a control device 6.

The control panel 1 is a part of an input portion in which an operator inputs information for operating the image forming apparatus 100. The control panel 1 has a touch panel or various hard keys. The hard keys include a ten key for inputting the number of sheets of paper for printing, or a start key for starting print processing.

The scanner portion 2 reads image information of a copy object (hereinafter, referred to as an original) as brightness and darkness of light. The scanner portion 2 outputs the read image information as image data to the printer portion 3 through the control device 6. The scanner portion 2 acquires additional information such as information of the size of the original. The scanner portion 2 outputs the additional information relating to an image together with the image data to the control device 6. The scanner portion 2 may have an automatic original feeding apparatus (ADF).

The printer portion 3 forms an output image (hereinafter, referred to as a toner image) using a developer containing a toner or the like based on the image data read by the scanner portion 2 or image data from the outside.

The printer portion 3 transfers a toner image to the surface of a sheet S. The printer portion 3 fixes the toner image to the sheet S by applying heat and pressure to the toner image on the surface of the sheet S.

The sheet supply portion 4 supplies the sheet S to the printer portion 3 one by one in accordance with the timing when the printer portion 3 forms a toner image. The sheet supply portion 4 has a plurality of paper feeding cassettes 20A, 20B, and 20C. Each of the paper feeding cassettes 20A, 20B, and 20C stores sheets S with previously set sizes and types. The paper feeding cassettes 20A, 20B, and 20C respectively have pickup rollers 21A, 21B, and 21C. Each of the pickup rollers 21A, 21B, and 21C takes out the sheets S from each of the paper feeding cassettes 20A, 20B, and 20C one by one. The pickup rollers 21A, 21B, and 21C supply the taken sheets S to the conveyance portion 5.

The conveyance portion 5 has a conveyance roller 23 and a resist roller 24. The conveyance portion 5 conveys the sheets S supplied from the pickup rollers 21A, 21B, and 21C to the resist roller 24. The resist roller 24 conveys the sheet S in accordance with the timing when the printer portion 3 transfers a toner image to the sheet S.

The conveyance roller 23 makes a tip end of the sheet S in a conveyance direction abut a nip N of the resist roller 24. The conveyance roller 23 aligns the position of the tip end of the sheet S in the conveyance direction by bending the sheet S.

The resist roller 24 matches the tip end of the sheet S in the nip N. Furthermore, the resist roller 24 conveys the sheet S to a transfer portion 28 side to be described later.

Next, the detailed configuration of the printer portion 3 will be described.

The printer portion 3 has image forming units 25Y, 25M, 25C, and 25K, the laser scanning unit 26, an intermediate transfer belt 27, the transfer portion 28, a fixing unit 29, and a transfer belt cleaning unit 31.

Each of the image forming units 25Y, 25M, 25C, and 25K forms a toner image on the intermediate transfer belt 27.

The image forming units 25Y, 25M, 25C, and 25K respectively have photoconductive drums. The image forming units 25Y, 25M, 25C, and 25K respectively form toner images of yellow, magenta, cyan, and black on the photoconductive drums.

A well-known charger, developing unit, transfer roller, cleaning unit, and static eliminator are disposed around the photoconductive drum. The transfer roller faces the photoconductive drum. The intermediate transfer belt 27 to be described later is interposed between the transfer roller and the photoconductive drum. The laser scanning unit 26 is disposed below the charger and the developing unit.

The laser scanning unit 26 irradiates the surface of each photoconductive drum with a laser beam. The laser scanning unit 26 is supplied with image data of yellow, magenta, cyan, and black.

The laser beam is modulated based on each of the image data pieces. The surface of each photoconductive drum is scanned with each laser beam. The static electricity in an exposed portion of each laser beam of the surface of each photoconductive drum is eliminated. Each laser beam forms an electrostatic latent image on the surface of each photoconductive drum.

The laser scanning unit 26 has a housing 40, a laser light source which is not shown in the drawing, a write optical system which is not shown in the drawing, the polygon motor 44, a fan motor 41, and an air blowing duct 42.

The housing 40 fixes the laser light source, the write optical system, and the polygon motor 44 with a constant positional relationship.

The laser light source has four laser diodes (hereinafter, referred to as LD) and driving circuits of the LDs. Laser light generated in the laser light source is made to be a collimated beam through a collimator lens. The laser light source is fixed to the side surface of the housing 40.

The write optical system has a cylindrical lens which is not shown in the drawing and an fθ lens which is not shown in the drawing.

The cylindrical lens linearly images a laser beam. The cylindrical lens is disposed between the laser light source and the polygon motor 44.

The fθ lens images a laser beam which is reflected by a polygon mirror 44*c* to be described later. The fθ lens has fθ characteristics. For this reason, the fθ lens performs constant speed scanning on an image surface with a laser beam which is scanned at an equal angle by the polygon motor 44. The fθ lens is disposed between the polygon motor 44 and the photoconductive drum.

Furthermore, the write optical system has a reflective mirror which folds an optical path of each laser beam.

The write optical system is fixed to the inside of the housing 40.

The polygon motor 44 performs deflective scanning with a laser beam in one direction. The polygon motor 44 has a polygon mirror 44*c*, a bearing 44*b*, and a motor substrate 44*a*.

The polygon mirror 44*c* is fixed to a rotor which is not shown in the drawing. The bearing 44*b* rotatably supports a rotary shaft of the rotor. The rotor which is not shown in the drawing receives rotary driving force from the motor substrate 44*a* to which the bearing 44*b* is fixed. The polygon motor 44 can use a DC motor.

The polygon motor 44 rotates while forming at least a latent image. When the printer portion 3 continuously prints a plurality of sheets S, the polygon motor 44 also continuously rotates during a period corresponding to an interval between the plural sheets.

The polygon motor 44 is a heating component. The accumulated amount of heat generated from the polygon motor 44 is proportional to the rotation time of the polygon motor 44.

The rotation time of the polygon motor 44 per print job is substantially equal (including a case of being equal) to a product of the printing speed (sheets/minute) and the number of prints in the print job.

The number of polygon motors 44 can be appropriately selected from 1 to 4. For example, the number of polygon motors 44 in the embodiment is one. Furthermore, the polygon motor 44 of the embodiment divides a laser beam corresponding to yellow and magenta and a laser beam corresponding to cyan and black in a direction opposite to each other.

The fθ lens of the write optical system is disposed in a direction of dividing each of the laser beams. In the embodiment, when the laser beam corresponding to yellow and magenta and the laser beam corresponding to cyan and black are deflected by the polygon mirror 44*c*, the laser beams are respectively incident on different fθ lenses. Laser beams penetrated through the fθ lenses are branched by a reflective mirror which is not shown in the drawing. The four branched laser beams are emitted by being divided into emitting ports 40*y*, 40*m*, 40*c*, and 40*k* of the housing 40. The four emitted laser beams image on the surface of the photoconductive drums. The photoconductive drum is repeatedly scanned with each of the imaged laser beams in a longitudinal direction through rotation of the polygon mirror 44*c*.

The polygon motor 44 of the embodiment is fixed to the central portion on the lower surface of the housing 40.

As shown in FIG. 4, the lower surface of the housing 40 of the embodiment is formed with a recessed polygon motor storing portion 40*d*. The polygon motor storing portion 40*d* is formed with an opening, not shown in the drawing, through which the polygon mirror 44*c* and the rotor are inserted. In the periphery of the opening which is not shown in the drawing, the motor substrate 44*a* is fixed to the lower surface of the housing 40.

The motor substrate 44*a* and the bearing 44*b* of the polygon motor 44 do not protrude downward further than the polygon motor storing portion 40*d*.

A first end portion E1 and a second end portion E2 of the polygon motor storing portion 40*d* are formed with openings 40*f* and 40*g*.

The opening 40*f* faces one side surface of the housing 40. For example, in the housing 40 of the embodiment, the opening 40*f* faces the front surface of the image forming apparatus 100 among the side surfaces of the housing 40.

The opening 40*g* communicates with an air discharge path 40*e*. The air discharge path 40*e* is a recessed portion which is formed on the lower surface of the housing 40. In the air discharge path 40*e*, an opening 40*h* is formed on the side surface on a side opposite to the one side surface of the housing 40.

As shown in FIG. 3, the polygon motor storing portion 40*d* and the air discharge path 40*e* are communication grooves. The polygon motor storing portion 40*d* and the air discharge path 40*e* crosses the lower surface of the housing 40 between the opening 40*f* and the opening 40*h*.

A radiation plate 43 is disposed inside the polygon motor storing portion 40*d*. The radiation plate 43 comes into contact with the motor substrate 44*a* which is fixed to the housing 40.

The radiation plate 43 radiates heat from the motor substrate 44*a* in the polygon motor storing portion 40*d*. The radiation plate 43 is cooled by air F passing through the inside of the polygon motor storing portion 40*d*.

As shown in FIG. 3, the fan motor 41 is driven based on a control signal from the control device 6 to be described later. A fan of the fan motor 41 is rotated through the driving of the fan motor 41. The fan motor 41 blows air through the rotation of the fan. The fan motor 41 is electrically connected to a fan motor drive circuit 45 as shown in FIG. 5. The fan motor drive circuit 45 is communicatively connected to the control device 6 to be described later.

As shown in FIG. 3, an air blowing duct 42 is positioned between the fan motor 41 and the opening 40*f* of the polygon motor storing portion 40*d*.

The air blowing duct 42 makes air flow, which is blown by the fan motor 41, face the polygon motor 44.

An air inlet port 42*a* opens at a first end portion e1 of the air blowing duct 42. The air inlet port 42*a* fixes the fan motor 41.

An air blowing port 42*b* opens at a position opposite to the opening 40*f* at a second end portion e2 of the air blowing duct 42.

The air blowing duct 42 is fixed to the side surface of the housing 40.

With such a configuration, the fan motor 41 sucks the air F from the air inlet port 42*a*. The fan motor 41 blows the air F to the inside of the air blowing duct 42. The air F is blown from the air blowing port 42*b* to the inside of the polygon motor storing portion 40*d*. The air F blown inside the polygon motor storing portion 40*d* flows toward the air discharge path 40*e* along the radiation plate 43. The air F coming into contact with the radiation plate 43 cools the radiation plate 43. The air F which reaches the air discharge path 40*e* is discharged to the side surface on a side (rear side of the image forming apparatus 100 in this embodiment) opposite to the housing 40 from the opening 40*h*.

The polygon motor 44 radiates heat through the radiation plate 43 during operation of the polygon motor 44. The air F cools the polygon motor 44 through the driving of the fan motor 41.

As shown in FIG. 1, the intermediate transfer belt 27 is formed of an endless belt. A plurality of rollers abut on the inner peripheral surface of the intermediate transfer belt 27. The plurality of rollers impart tension to the intermediate transfer belt 27. The plurality of rollers flatly stretch the intermediate transfer belt 27. The inner peripheral surface of the intermediate transfer belt 27 abuts on a support roller 28*a* at one position which is most separated in a stretching direction. The inner peripheral surface of the intermediate transfer belt 27 abut on a transfer belt roller 32 at the other position which is most separated in the stretching direction.

The support roller 28*a* forms a part of the transfer portion 28 to be described later. The support roller 28*a* guides the intermediate transfer belt 27 to a secondary transfer position.

The transfer belt roller 32 guides the intermediate transfer belt 27 to a cleaning position.

The image forming units 25Y, 25M, 25C, and 25K are arranged on the lower surface of the intermediate transfer belt 27 which is shown in the drawing in this order excluding the transfer roller from the transfer belt roller 32 to the transfer portion 28. The image forming units 25Y, 25M, 25C, and 25K are arranged with a gap from each other in a region between the transfer belt roller 32 and the support roller 28*a*.

Each of the developing units of the image forming units 25Y, 25M, 25C, and 25K stores a developer containing each of toners of yellow, magenta, cyan, and black. Each of the developing units develops electrostatic latent image on the photoconductive drum. Each of the developing units forms a toner image on the photoconductive drum.

Each of the transfer rollers of the image forming units 25Y, 25M, 25C, and 25K transfers a toner image on the surface of each of the photoconductive drums to the intermediate transfer belt 27 (primary transfer).

When the toner image reaches a primary transfer position, a transfer bias is applied to each of the transfer rollers.

Each of the cleaning units of the image forming units 25Y, 25M, 25C, and 25K removes an untransferred toner on the surface of a photoconductive drum after the primary transfer through scraping or the like.

Each of the static eliminators of the image forming units 25Y, 25M, 25C, and 25K irradiates the surface of a photoconductive drum which passes through the cleaning unit with light. Each of the static eliminators eliminates static electricity of the photoconductive drum.

In the intermediate transfer belt 27, the transfer portion 28 is positioned at a position adjacent to the image forming unit 25K.

The transfer portion 28 has the support roller 28*a* and a secondary transfer roller 28*b*. The secondary transfer roller 28*b* and the support roller 28*a* interpose the intermediate transfer belt 27. The position at which the secondary transfer roller 28*b* and the intermediate transfer belt 27 abut on each other is the secondary transfer position.

The transfer portion 28 transfers a toner image on the intermediate transfer belt 27 to the surface of a sheet S at the secondary transfer position. The transfer portion 28 applies a transfer bias to the secondary transfer position. The transfer portion 28 transfers the toner image on the intermediate transfer belt 27 to the sheet S using the transfer bias.

The fixing unit 29 applies heat and pressure to the sheet S. The fixing unit 29 fixes the toner image which is transferred to the sheet S through heat and pressure.

The transfer belt cleaning unit 31 faces the transfer belt roller 32. The transfer belt cleaning unit 31 interposes the intermediate transfer belt 27. The transfer belt cleaning unit 31 scraps the toner on the surface of the intermediate transfer belt 27. The transfer belt cleaning unit 31 collects the scrapped toner in a waste toner tank.

The printer portion 3 further has a reversing unit 30. The reversing unit 30 reverses a sheet S which is discharged from the fixing unit 29 through switchback operation. The reversing unit 30 conveys the reversed sheet S again to the inside of a conveyance guide in front of the resist roller 24. The reversing unit 30 reverses the sheet S in order to form an image on a rear surface thereof.

Next, the control device 6 will be described.

The control device 6 controls each device part of the image forming apparatus 100. The control performed by the control device 6 includes control of the scanner portion 2, control of the printer portion 3, and control of the fan motor 41.

As shown in FIG. 5, the control device 6 is communicatively connected to an input portion 101, the printer portion 3, and the fan motor drive circuit 45. The control device 6 controls the printer portion 3 and the fan motor drive circuit 45 based on an instruction which is input from the input portion 101.

The input portion 101 has a printer interface 102 and the above-described control panel 1 and scanner portion 2.

The printer interface 102 is an interface when using the image forming apparatus 100 as a printer. The printer interface 102 is connected to a communication line. The printer interface 102 transmits a print job to the control device 6 through the communication line.

The image forming apparatus 100 performs printing by considering a print job from a user as a unit. The print job is a processing unit of print processing. The print job is data and a command to be processed in the image forming apparatus.

The print job includes at least information such as image data to be printed, the size of an image, the number of images, and the number of prints. Here, the size of the image is a size of printing on a sheet S. For example, the information of the size of the image is used when automatically selecting a paper feeding cassette for supplying a sheet S to be printed.

The number of prints per print job can be calculated as the number of images x the number of prints. When printing both faces, the number of images is twice that of the case of printing a single face. The number of prints based on the print job is called a printing number setting value NO in order to distinguish it from the number of printed sheets.

Print jobs are collectively transmitted to the control device 6 when input to the printer interface 102.

In contrast, when performing printing after an original is read by the scanner portion 2, a print job is formed after the original is read by the scanner portion 2.

A user performs key input for at least starting printing, using the control panel 1. When the key input for starting printing is performed, the control device 6 makes the scanner portion 2 read the original before starting printing using the printer portion 3.

The user may perform setting, which becomes a part of a command of a print job, through the control panel 1 before performing the key input for starting printing. For example, the user performs setting of the number of prints, the paper feeding cassette to supply a sheet S, the size of an original, the direction of the original, variable magnification, both-face printing, and the like.

Here, a feeding direction of the sheet S will be described. It is set such that the external shape of the sheet S is a rectangular shape with a long side and a short side. The direction in which the sheet S is conveyed within the image forming apparatus 100 is called the conveyance direction. "Transverse feeding" of a sheet S refers that the sheet S is conveyed in a direction in which a long side of the sheet S is orthogonal to the conveyance direction. "Longitudinal feeding" of a sheet S refers that the sheet S is conveyed in a direction in which a short side of the sheet S is orthogonal to the conveyance direction.

As commands of other print jobs which are not set by a user, a default value stored in the control device 6, or information of an original read by the scanner portion 2 is used. For example, the scanner portion 2 detects the size of the original. The scanner portion 2 can acquire the size of the original and the direction of the original as information of the original. When the scanner portion 2 has an ADF, the scanner portion 2 can acquire the size of the original, the direction of the original, and the number of sheets of the original as information of the original when reading the original.

When the reading of the original using the scanner portion 2 is completed, the scanner portion 2 transmits the read information such as image data to the control device 6. At this time, all of data and commands constituting a print job are determined together with the input from the control panel 1.

Hereinafter, unless otherwise specified, it will be described such that print jobs are collectively transmitted from the input portion 101 to the control device 6 for simplification.

The image forming apparatus 100 has a power source 51 for supplying an electrical power to each device part. The power source 51 has a power source switch 50 for switching on and off of the power source 51.

The control device 6 has the counter 61, a timer 62, a storage unit 63, and a control unit 60.

The counter 61 counts an operation time of the printer portion 3 or a value which is replaced with the operation time of the printer portion. The "value which is replaced with the operation time of the printer portion" is a value which can be replaced with measurement of the length of the operation time of the printer portion 3. Examples of the "value which is replaced with the operation time of the printer portion" include a value which is correlated with the operation time of the printer portion 3.

The accumulated amount of heat generated from a heating component to be cooled by the fan motor 41 is proportional to the driving time of the heating component when the amount of generated heat per unit time is constant. The heating component of the printer portion 3 is used for forming an image. The driving time of the heating component of the printer portion 3 is the same as the operation time of the printer portion 3, or has a correlation with the operation time of the printer portion 3. Here, the operation time of the printer portion 3 refers to a time period between start of printing and completion of printing based on a print job. The printing of the printer portion 3 is started by the control device 6 receiving a print job as described later.

In the embodiment, the fan motor 41 cools the polygon motor 44 as the heating component. As will be described later, the driving time per print job in the polygon motor 44 of the embodiment is substantially equal (including a case of being equal) to the operation time of the printer portion 3.

The counter 61 counts the number of prints as an example of the "value which is replaced with the operation time of the printer portion". Here, the number of prints counted by the counter 61 refers to the number of sheets of images formed on a sheet S, but does not refer to the number of sheets S to be used for printing. When printing both faces, the number of prints becomes twice that of the case of printing a single face.

The driving time of the polygon motor 44 varies depending on the length of the sheet S in the conveyance direction (sub-scanning direction).

The counter 61 changes the count value with respect to one sheet of the image in accordance with the size and the feeding direction of the sheet S to be used for printing. The size and the feeding direction of the sheet S are notified from the control unit 60 to be described later.

An example of the count value in the image forming apparatus 100 is shown in FIG. 6. The count value is stored in the storage unit 63 to be described later.

In FIG. 6, the symbols such as A4 and B5 in the sheet column indicate the size of the sheet S. The symbol –R indicates that the sheet S is longitudinally fed. The sizes without the symbol –R indicate that the sheets are transversely fed.

The counter 61 has a job counter 61*a* and a combined job counter 61*b* depending on the type of the number of prints counted.

The job counter 61*a* counts the number of prints per print job. The job counter 61*a* is reset to 0 when the print job is completed and when the power source 51 is turned off.

The combined job counter 61*b* counts the number of prints in a print job, similarly to the job counter 61*a*. However, the condition of resetting is different from that of the job counter 61*a*. In some cases, the combined job counter 61*b* counts the number of prints over a plurality of print jobs.

The combined job counter 61*b* is reset to 0 when the power source 51 is turned off similarly to the job counter 61*a*. However, the combined job counter 61*b* is not reset when a print job is completed. The combined job counter 61*b* is reset to 0 when another first print job is started after a print job is completed, in accordance with determination of the control unit 60 to be described later.

The count values of the job counter 61*a* and the combined job counter 61*b* can be read by the control unit 60.

The timer 62 measures a printing start time and a printing completion time based on the print job. The timer 62 is driven by a power source, such as a long-life battery, other than the power source 51.

The timer 62 receives a notification from the control unit 60 to be described later when receiving a print job and when completing the print job. The reception of the print job means start of a printing operation.

When the timer 62 receives a notification when receiving a print job from the control unit 60, the timer transmits the time when the notification is received to the control unit 60 as a job reception time t1. The job reception time t1 is a printing start time based on a print job.

When the timer 62 receives a notification when completing printing from the control unit 60, the timer transmits the time when the notification is received to the control unit 60 as a printing completion time.

The storage unit 63 stores data and an operation result which are required for processing and operation in the control device 6. The storage unit 63 stores information required for a control performed by the control unit 60.

For example, the storage unit 63 stores a print job transmitted to the control device 6. The storage unit 63 stores a printing number setting value NO included in the print job.

For example, the storage unit 63 stores a start time (job reception time t1) and a completion time (printing completion time t0) for printing which are output from the control unit 60 to be described later.

The storage unit 63 stores a count value (refer to FIG. 6) for each size of the above-described sheets S, and a first threshold value T, a second threshold value Nf, and the allowable number of remaining sheets Na which are to be described later.

The storage unit 63 is formed of a ROM, a RAM, and an HDD.

The control unit 60 controls each device part of the image forming apparatus 100. The control unit 60 is a CPU.

For example, the control unit 60 controls a printing operation of the printer portion 3 based on a print job from the input portion 101.

For example, when a user performs a key input for starting printing, using the control panel 1, the control unit 60 makes the scanner portion 2 perform an operation of reading an original.

The control unit 60 controls the printing operation of the printer portion 3 based on a print job formed of data and a command which are transmitted from the control panel 1 and the scanner portion 2.

For example, in some cases, print jobs are collectively transmitted from the printer interface 102. In this case, the control unit 60 controls the printing operation of the printer portion 3 based on the print jobs from the printer interface 102.

When the control device 6 receives a print job, the control device 6 starts printing. First, the control unit 60 notifies the timer 62 of reception of the print job. The control unit 60 acquires a job reception time t1 which is transmitted from the timer 62.

When the print job is completed, the control unit 60 notifies the timer 62 of the completion of the print job. The control unit 60 acquires a printing completion time t0 which is transmitted from the timer 62.

The control unit 60 stores the job reception time t1 and the printing completion time t0 in the storage unit 63.

The control unit 60 can calculate the time interval between print jobs which are continuously performed by calculating the difference between a job reception time t1 of a print job which is being executed and a most recent printing completion time t0.

Furthermore, the control unit 60 cools the polygon motor 44 by controlling the operation of the fan motor 41. The control unit 60 cools the image forming apparatus 100 by cooling the polygon motor 44 which is a heating component.

Here, an outline of a cooling control method for the image forming apparatus of the embodiment will be described.

When the polygon motor 44 rotates, Joule heat is generated from the motor substrate 44*a* and the rotor. Furthermore, air frictional heat due to rotation of the polygon mirror 44*c* is generated. The generated heat is conducted to the radiation plate 43 and the housing 40. Furthermore, the generated heat is also radiated within the housing 40. The generated heat increases the temperature within the image forming apparatus 100.

A temperature range during operation is defined in the polygon motor 44 and the image forming apparatus 100 in view of durability and stable operation. For example, the operating environment temperature of the polygon motor 44 is lower than or equal to 60° C. For example, the operating environment temperature of the image forming apparatus 100 is lower than or equal to 30° C.

As will be described later, if the fan motor 41 is driven, the polygon motor 44 is cooled.

However, the operating environment temperature of the polygon motor 44 before starting a printing operation is lower than 60° C. even if the fan motor 41 is not driven. A certain time is required until the operating environment temperature exceeds 60° C. even if the polygon motor 44 rotates. For example, the installing environment temperature of the image forming apparatus 100 is set to 30° C. and the printing speed (number of prints per minute) of the image forming apparatus 100 is set to 50 (sheets/minute) (in terms of A4). In this case, even if sheets S of A4 are continuously printed for 1 hour, the operating environment temperature of the polygon motor 44 is 59° C. The driving time of the polygon motor 44 in the continuous printing for 1 hour is about 1 hour. The 3000 sheets S of A4 are printed in the continuous printing for 1 hour. The operating environment temperature of the polygon motor 44 is 59.5° C. even if 20 sheets S of A4 are further printed in this state.

The control unit 60 drives the fan motor 41 based on the number of prints counted by the counter 61. The control unit 60 drives the fan motor 41 such that the operating environment temperature of the polygon motor 44 does not exceed an allowable temperature range.

The control unit 60 of the embodiment starts driving of the fan motor 41 when the number of prints n counted by the combined job counter 61*b* exceeds the second threshold value Nf and the number of remaining prints nr exceeds the allowable number of remaining sheets Na. That is, the control unit starts driving of the fan motor 41 in the case of n>Nf and nr>Na. Even if a print job is started, the control unit 60 does not drive the fan motor 41 in the case of n≤Nf or nr≤Na.

The second threshold value Nf refers to an allowable value of the number of prints when performing continuous printing without driving the fan motor 41 (hereinafter, referred to as continuous printing during stoppage of the fan) The second threshold value Nf is set to the number of sheets in which the temperature of a heating component to be cooled by the fan motor 41 does not exceed an operation allowable temperature even if Nf sheets are printed through continuous printing during stoppage of the fan.

The number of remaining prints nr refers to the number of remaining prints in a print job which is being executed. When the number of prints counted by the job counter 61*a* is set to m, nr is N0−m.

The allowable number of remaining sheets Na refers to an allowable value of the number of prints when performing continuous printing during stoppage of the fan after Nf sheets of prints are continuously printed during stoppage of the fan. The allowable number of remaining sheets Na is set to the number of sheets in which the temperature of a heating component to be cooled by the fan motor 41 does not exceed an operation allowable temperature even if (Nf+Na) sheets of prints are continuously printed during stoppage of the fan.

For example, when the heating component is the polygon motor 44 and the image forming apparatus 100 satisfies the above-described numerical example, Nf may be set to 3000 (sheets) and Na may be set to 20 (sheets).

When one print job is completed, the polygon motor 44 is stopped. Heat generation of the polygon motor 44 also stops at this time, and therefore, the polygon motor 44 is naturally cooled by air. The operating environment temperature of the polygon motor 44 also decreases immediately.

A second print job is set to be started immediately after the completion of the first print job with the number of prints N1 (where N1≤Nf). In the second print job, heat generation of the polygon motor 44 starts from a state where the operating environment temperature of the polygon motor 44 is comparatively higher than the outside air temperature.

In this case, there is a concern that the operating environment temperature of the polygon motor 44 may exceed the allowable value when driving of the fan motor 41 is determined only by the number of prints of the second print job.

In contrast, cooling of the polygon motor 44 progresses in accordance with the time interval between the first print job and the second print job. For example, when the second print job starts after the lapse of a certain time, the operating environment temperature of the polygon motor 44 becomes substantially the same as the outside air temperature. In this case, it is possible to determine the driving of the fan motor 41 only by the number of prints of the second print job without considering a temperature rise in the first print job.

When the time interval between a print job J1 and a print job J2 which are continuously executed is less than or equal to the first threshold value T, the control unit 60 of the embodiment regards the print jobs J1 and J2 as a combined job. Furthermore, when a print job J3 is further performed with an interval less than or equal to the first threshold value T, the print job J3 is also included in the combined job. Hereinafter, in some cases, a print job which cannot be regarded as a combined job is called a single job.

The control unit 60 determines whether the first print job and the second print job can be regarded as the combined job when two print jobs which are continuously executed are called a first print job and a second print job in execution order. When the first print job and the second print job can be regarded as a combined job, the control unit 60 makes the combined job counter 61*b* count the number of prints as the combined job.

The control unit 60 resets the combined job counter 61*b* to 0 when the first print job and the second print job cannot be regarded as a combined job.

Here, the first threshold value T between print jobs, for which it is determined as a combined job, is determined from the time required for natural cooling after the polygon motor 44 stops. The first threshold value T can be obtained through experiments.

For example, the polygon motor 44 is stopped in a state where the continuous printing during stoppage of the fan is performed up to the second threshold value Nf. The operating environment temperature of the polygon motor 44 is measured after the polygon motor 44 is stopped. The first threshold value T is set to the time required for the operating environment temperature of the polygon motor 44 to decrease up to the outside air temperature.

For example, in the case of the image forming apparatus 100 of the embodiment, T is 30 (minutes).

A more specific controlling method of the fan motor 41 using the control unit 60 will be described in the description of an operation to be described later.

The device configuration of the above-described control device 6 includes appropriate software and a computer having a CPU, a memory, an input and output interface, an external storage device, and the like. The control device 6 realizes the above-described functions by causing hardware or a computer to execute a control program.

Next, in regard to an operation of the image forming apparatus 100, the cooling control method for the image forming apparatus 100 will be mainly described.

First, an outline of the printing operation of the image forming apparatus 100 will be described excluding the cooling control method for the image forming apparatus 100.

In the image forming apparatus 100, when a print job from the input portion 101 is transmitted to the control device 6, printing of a sheet S is started by control of the control unit 60 based on the print job.

At least information of the size of an image, the number of images, and the number of prints are included in the print job.

The control unit 60 transmits a control signal and image data to the printer portion 3 based on the print job.

The printer portion 3 supplies a sheet S suited to the size of the image from the sheet supply portion 4 to the resist roller 24. The printer portion 3 drives the polygon motor 44 of the laser scanning unit 26. The laser light source modulates each of laser beams in accordance with image data. Each of the photoconductive drums of the image forming units 25Y, 25M, 25C, and 25K is scanned with each of the laser beams emitted from the housing 40. Each of the photoconductive drums is formed with an electrostatic latent image in accordance with each image data piece.

The image forming units 25Y, 25M, 25C, and 25K respectively develop electrostatic latent images formed on the photoconductive drums using a developing unit. The surface of each of the photoconductive drums is formed with a toner image corresponding to the electrostatic latent image.

Each of the transfer rollers primarily transfers each of the toner images to the intermediate transfer belt 27. At this time, the control unit 60 shifts the transfer timing in accordance with the arrangement position of the image forming units 25Y, 25M, 25C, and 25K. For this reason, the toner images are sequentially overlapped without causing a color shift, together with the movement of the intermediate transfer belt 27. The overlapped toner images move to the transfer portion 28.

The transfer portion 28 secondarily transfers the toner images, which reached the transfer portion, to a sheet S that is fed from the resist roller 24 to the transfer portion 28. The fixing unit 29 fixes the secondarily transferred toner images to the sheet S. The sheet S to which the toner images are fixed is discharged to the outside of the image forming apparatus 100.

The transfer belt cleaning unit 31 scraps a transfer residual toner which cannot be transferred on the sheet S using the transfer portion 28. The transfer belt cleaning unit 31 cleans such that the intermediate transfer belt 27 is reusable.

Hereinabove, printing on one sheet S is completed.

In print jobs, when the number of prints is plural, the image forming apparatus 100 continuously performs the above-described printing operation with a sheet interval which is previously set.

Next, a cooling operation of the image forming apparatus 100 through driving of the fan motor 41 will be described. As will be described below, the control unit 60 drives the fan motor 41 in parallel with the above-described printing operation when it is necessary to cool the polygon motor 44.

Figure 7:
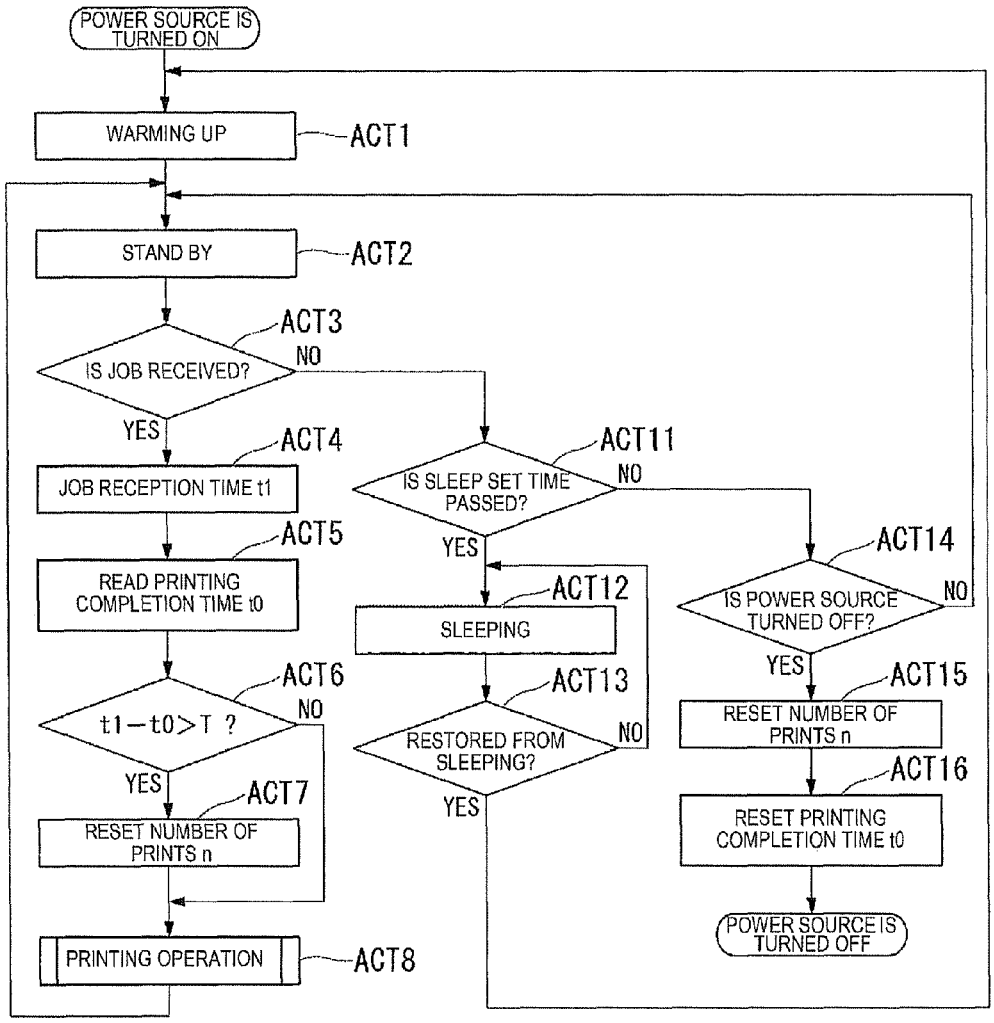
FIG. 7 is a flowchart showing an example of a cooling control method for the apparatus.
Figure 8:
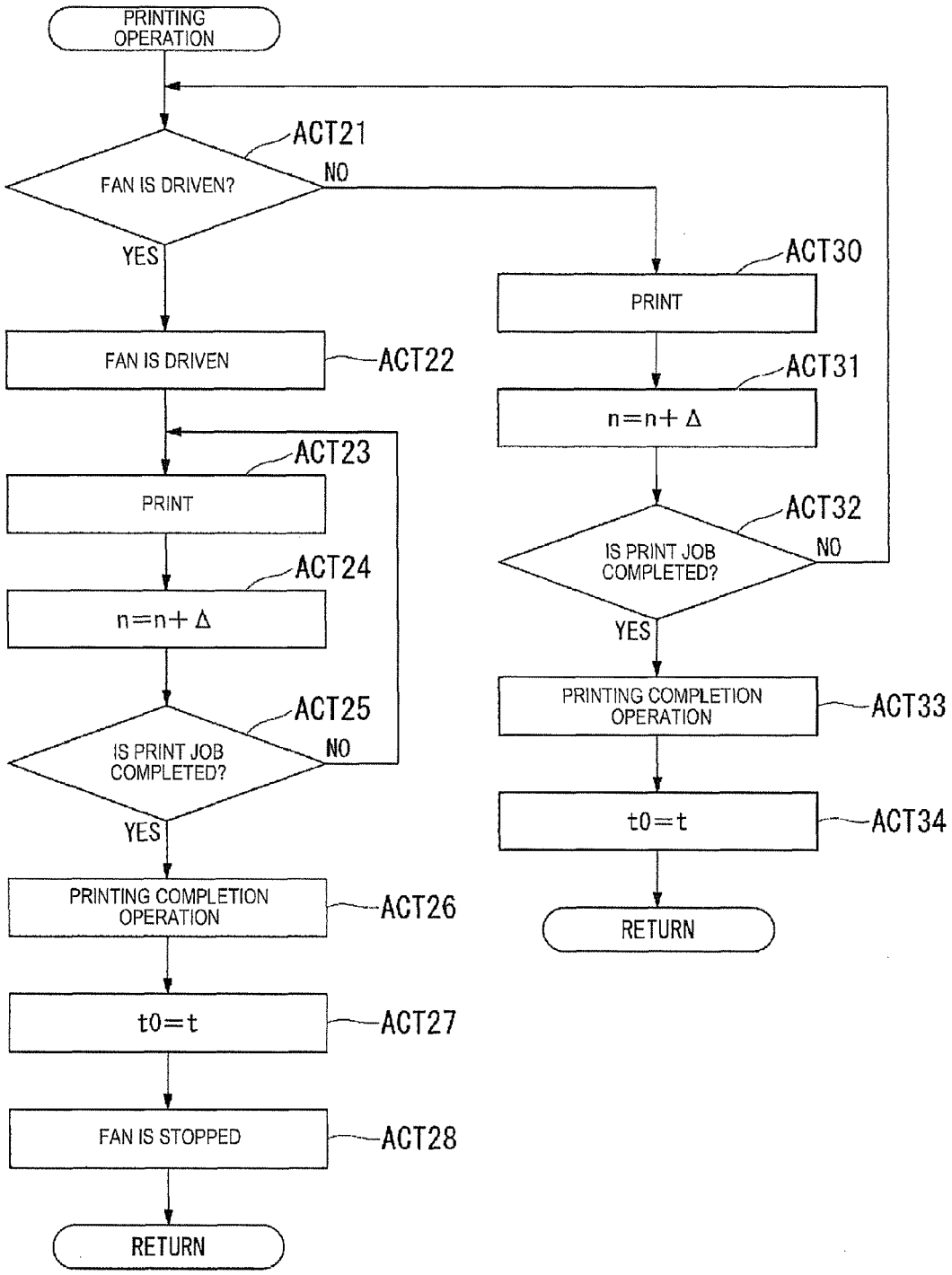
FIG. 8 is a flowchart showing an example of a cooling control method for the apparatus.

FIG. 7 is a flowchart showing an example of the cooling control method for the image forming apparatus 100 of the embodiment. FIG. 8 is a flowchart showing an example of the cooling control method for the image forming apparatus 100 of the embodiment.

When printing an image on a sheet S using the image forming apparatus 100, first, an operator turns on the power source 51 of the image forming apparatus 100 by operating the power source switch 50.

Hereinafter, an example of a case of performing printing on a single face of a sheet S of A4 which is used for a print job and is transversely fed will be described for simplification. However, the size or the feeding direction of the sheet S may be changed for each print job or during execution of a print job. For example, when there is no sheet S of A4 for transverse feeding in the paper feeding cassette, the control unit 60 may perform printing by switching the sheet to a sheet S of A4 for longitudinal feeding. In this case, the control unit 60 notifies the counter 61 of the switching of the sheet S to the sheet S of A4 for longitudinal feeding. The counter 61 reads a count value of the sheet of A4 for longitudinal feeding from the storage unit 63. The counter 61 changes the counter value corresponding to the number of sheets S from 1 (/sheet) to 1.39 (/sheet).

As shown in FIG. 7, the image forming apparatus 100 performs warming-up of each device part (ACT 1).

Examples of the warming-up in ACT 1 include an operation of increasing the temperature of the fixing unit 29 to a target temperature in a standby state.

Furthermore, the control unit 60 may perform initializing or resetting of control data as necessary during ACT 1. However, the control unit 60 does not reset a value of the combined job counter 61*b* and a printing completion time t0 which is stored in the storage unit 63, in ACT 1.

The values of the combined job counter 61*b* and the printing completion time t0 when the power source 51 of the image forming apparatus 100 is first turned on are initial values which are set during manufacturing. For example, the initial value of the combined job counter 61*b* which is set during manufacturing is 0. For example, the initial value of the printing completion time t0 which is set during manufacturing is 0.

When ACT 1 is completed, the image forming apparatus 100 performs an operation entering the following standby state (ACT 2).

The control unit 60 starts to receive an input by the input portion 101. The laser scanning unit 26 keeps the polygon motor 44 in a stopped state. The printer portion 3 keeps the temperature of the fixing unit 29 as in the standby state. The printer portion 3 rotates an air discharge fan, which is not shown in the drawing, at a rotation speed during standby. The air discharge fan which is not shown in the drawing discharges air within the apparatus warmed by the fixing unit 29 to the outside of the apparatus. For this reason, the operating environment temperature of the polygon motor 44 in the standby state is substantially equal to the outside air temperature.

When the standby state is realized, the control unit 60 displays the standby state on the control panel 1. Furthermore, the control unit 60 acquires the time when the apparatus enters the standby state, from the timer 62 and stores the acquired time in the storage unit 63 as a standby state start time tr.

After ACT 2, the control unit 60 determines whether to receive a print job (ACT 3).

In ACT 3, the control unit 60 monitors an input from the input portion 101. The control unit 60 analyzes the input when an input occurs from the input portion 101.

When the control unit 60 determines that a print job cannot be received (ACT 3: NO), ACT 11 is performed.

When the control unit 60 determines that a print job can be received (ACT 3: YES), ACT 4 is performed.

An example of the case where the control unit 60 determines that a print job cannot be received (ACT 3: NO) is as follows.

For example, when an input occurs during a monitoring period and the input is not a print job, the control unit 60 determines that the print job cannot be received. In this case, the control unit 60 performs an operation corresponding to the input as necessary. Then, ACT 11 is performed. For example, when the input from the control panel 1 is an input to change the setting of the condition of the image forming apparatus 100, the control unit 60 changes the setting of the condition based on the input. Then, ACT 11 is performed.

For example, when no input occurs during the monitoring period, there is also no input of a print job, and therefore, the control unit 60 determines that the print job cannot be received.

For example, when a print job is input during the monitoring period, the control unit 60 determines that it is possible to receive the print job based on the print job. For example, it is set such that there is no type of a sheet S corresponding to the print job in the sheet supply portion 4. In this case, the control unit 60 determines that the print job cannot be received. The control unit 60 displays a warning massage such as "out of paper" on the control panel 1. Then, ACT 11 is performed.

In contrast, when a print job is input during the monitoring period and the control unit 60 determines that it is possible to print based on the print job (ACT 3: YES), ACT 4 is performed.

First, a flow in which ACT 4 is performed after ACT 3 will be described.

In ACT 4, the control unit 60 notifies the timer 62 of the reception of the print job. The timer 62 measures the time t when the notification is received, and transmits the time to the control unit 60 as a job reception time t1. The control unit 60 stores the job reception time t1 in the storage unit 63.

When ACT 4 is completed, ACT 5 is performed.

In ACT 5, the control unit 60 reads the printing completion time t0 from the storage unit 63. The storage unit 63 stores any of the initial value during manufacturing, the completion time for most recent print job, and a reset value in ACT 16 to be described later, as the printing completion time t0.

When ACT 5 is completed, ACT 6 is performed.

In ACT 6, the control unit 60 reads the job reception time t1 and the first threshold value T from the storage unit 63. Then, the control unit 60 calculates t1−t0. The control unit 60 determines whether t1−t0 is greater than T.

In the case of t1−t0>T, the control unit 60 determines that the received print job is a single job or a first print job in a combined job.

In contrast, in the case of t1−t0≤T, the control unit 60 determines that the received print job is a second or subsequent print job in the combined job.

In the case of t1−t0>T (ACT 6: YES), ACT 7 is performed.

In the case of t1−t0≤T (ACT 6: NO), ACT 8 is performed.

When the power source of the image forming apparatus 100 is first turned on, t1−t0 is greater than T, and therefore, ACT 7 is necessarily performed.

In ACT 7, the control unit 60 resets the number of prints n in the combined job counter 61*b* to 0.

When ACT 7 is completed, ACT 8 is performed.

In ACT 8, the image forming apparatus 100 performs a printing operation. The image forming apparatus 100 performs an operation of the flow shown in FIG. 8. However, when ACT 7 is performed, the printing operation is performed after the combined job counter 61*b* is reset to 0. When ACT 7 is not performed, the printing operation is performed in a state where the counting of the combined job counter 61*b* is continued.

As shown in FIG. 8, ACT 21 is first performed. In ACT 21, the control unit 60 determines whether to start driving of the fan motor 41 (abbreviated to "driving of fan" in ACT 21).

The control unit 60 reads the number of prints m from the job counter 61*a* and the number of prints n from the combined job counter 61*b*.

Furthermore, the control unit 60 reads the printing number setting value NO of a print job which is being executed, the second threshold value Nf, and the allowable number of remaining sheets Na from the storage unit 63. In the embodiment, for example, Nf is 3000 (sheets) and Na is 20 (sheets).

The control unit 60 calculates the number of remaining prints nr of a print job which is being executed, as nr=N0−m. The control unit 60 determines whether n and nr satisfy n>Nf and nr>Na.

In the cases of n>Nf and nr>Na, the control unit 60 determines to start driving of the fan motor 41 (ACT 21: YES). In this case, ACT 22 is performed.

In the case of n≤Nf or nr≤Na, the control unit 60 determines not to start driving of the fan motor 41 (ACT 21: NO). In this case, ACT 30 is performed.

In ACT 22, the control unit 60 transmits a control signal for driving the fan motor 41 to the fan motor drive circuit 45. The fan motor drive circuit 45 starts driving of the fan motor 41.

Hereinabove, ACT 22 is completed. Then, ACT 23 is performed.

In ACT 23, the image forming apparatus 100 starts printing on a sheet S based on a print job. That is, the sheet supply portion 4 supplies the sheet S. Then, the operation of printing on the sheet S is as described above.

When printing on the sheet S starts, the printing operation on the sheet S is completed and ACT 24 is performed.

In ACT 24, the combined job counter 61*b* counts the number of prints n as n=n+Δ. Here, Δ is a count value which is determined based on the size and the feeding direction of the sheet S. An example of the count value used as Δ is shown in FIG. 6. For example, in the case of a sheet of A4 for transverse feeding, Δ is 1. Furthermore, the job counter 61*a* counts the number of prints m as m=m+Δ.

Hereinabove, ACT 24 is completed. Then, ACT 25 is performed.

In ACT 25, the control unit 60 determines whether to complete the print job.

The control unit 60 reads the printing number setting value N0 from the storage unit 63. The control unit 60 acquires the number of prints m from the job counter 61*a*. The control unit 60 calculates N0−m. The control unit 60 determines whether to complete the print job based on the calculated value of N0−m.

In the case of N0−m≤0 (ACT 25: YES), ACT 26 is performed.

In the case of N0−m>0 (ACT 25: NO), ACT 23 is performed.

In this manner, the image forming apparatus 100 continues the printing through ACT 25 until printing on an N0-th sheet S is performed.

ACT 26 is performed after the printer portion 3 starts printing on a final sheet S based on the print job. In ACT 26, the control unit 60 performs a printing completion operation when the printing on the N0-th sheet S is completed.

The printing completion operation is an operation of sequentially restoring the image forming apparatus 100 to the standby state.

In ACT 26, for example, when the control unit 60 detects completion of exposure of the NO-th sheet S, then the control unit stops the polygon motor 44. The driving of the polygon motor 44 may be stopped immediately after the completion of the exposure. In addition, the driving of the polygon motor 44 may be stopped after completion of discharge of a final sheet S.

Furthermore, when the control unit 60 detects completion of fixation of the N0-th sheet S, then the control unit controls the temperature of the fixing unit 29 toward the temperature in the standby state.

Furthermore, when the control unit 60 detects completion of the discharge of the NO-th sheet S, the control unit 60 stops an operation of the conveyance portion 5.

ACTs 27 and 28 are performed after ACT 26.

In ACT 27, the control unit 60 acquires a current time t from the timer 62. The control unit 60 stores the time t in the storage unit 63 as the printing completion time t0.

In ACT 28, the control unit 60 stops the fan motor 41 by transmitting a control signal to the fan motor drive circuit 45.

ACTs 27 and 28 may be performed in this order as shown in FIG. 8, but can also be performed by exchanging the order.

Furthermore, ACT 28 may be performed as a part of ACT 26 after the polygon motor 44 is stopped. For example, the control unit 60 may stop the fan motor 41 simultaneously with the polygon motor 44. For example, the control unit 60 may stop the fan motor 41 simultaneously with stoppage of the air discharge fan which is not shown in the drawing, along with decrease in the temperature of the fixing unit 29.

In this manner, ACT 8 shown in FIG. 7 is completed when ACTs 27 and 28 are completed.

ACT 2 shown in FIG. 7 is performed after ACT 8.

Next, a flow in which ACT 30 is performed after ACT 21 in FIG. 8 will be described.

In ACT 30, the same operation as that in the above-described ACT 23 is performed. However, ACT 22 is not performed between ACT 21 and ACT 30. For this reason, in ACT 30, the fan motor 41 is stopped.

ACT 31 is performed after ACT 30 is performed. In ACT 31, the same operation as that in the above-described ACT 24 is performed.

ACT 32 is performed after ACT 31 is performed. In ACT 32, the control unit 60 determines whether to complete a print job, similarly to ACT 25.

In the case of N0−m≤0 (ACT 32: YES), ACT 33 is performed.

In the case of N0−m>0 (ACT 32: NO), ACT 21 is performed. ACT 21 is performed because the number of prints n is increased through the execution of ACT 30.

In this manner, the flow from ACT 21 to ACT 32 is repeated while the number of prints n and the number of remaining prints nr do not satisfy the condition to start the driving of the fan motor 41 (ACT 21: NO).

When the number of prints m reaches NO (ACT 32: YES), ACTs 33 and 34 are performed.

In ACTs 33 and 34, the same operations as those in the above-described ACTs 26 and 27 are performed. The order of performing ACTs 33 and 34 may be changed, similarly to the above-described ACTs 26 and 27.

In this manner, ACT 8 in FIG. 7 is completed when ACTs 33 and 34 are completed.

When the printing is completed by performing ACT 32, the fan motor 41 is in a stopped state, and therefore, it is unnecessary to perform ACT 28.

ACT 2 shown in FIG. 7 is performed after ACT 8.

Next, a flow in which ACT 11 is performed after ACT 3 will be described.

As shown in FIG. 7, in ACT 11, the control unit 60 determines whether a sleep set time Ts is elapsed.

The sleep set time Ts is a time after completion of a print job up to the state of the apparatus automatically enters a sleep mode. When the sleep mode is only set manually, the sleep set time Ts is set to, for example, a very large value. The storage unit 63 stores the sleep set time Ts.

The sleep mode is one of power saving functions of the image forming apparatus 100. In the sleep mode, an electrical power is supplied only to a minimum device part, which is required for being restored from the sleep mode, among the control device 6.

In ACT 11, the control unit 60 reads the standby state start time tr and the sleep set time Ts from the storage unit 63. The control unit 60 acquires the current time t from the timer 62. The control unit 60 calculates t−tr−Ts.

In the case of t−tr−Ts<0 (ACT 11: NO), the elapsed time after the apparatus enters a standby state is shorter than the sleep set time Ts, and therefore, ACT 14 is performed.

In the case of t−tr−Ts≥0 (ACT 11: YES), the elapsed time after the apparatus enters a standby state is longer than or equal to the sleep set time Ts, and therefore, ACT 12 is performed.

In ACT 12, the control unit 60 makes the image forming apparatus 100 enter the sleep mode.

ACT 13 is performed after ACT 12. In ACT 13, occurrence of an instruction (hereinafter, referred to as a restore instruction) to restore a device part (hereinafter, referred to as sleep restoration control unit) of the control device 6 to which an electrical power is supplied, from the sleep mode is monitored in a constant monitoring period.

Examples of the restore instruction include an operation in which an operator presses a power source button of the control panel 1 for a long period of time. Other examples of the restore instruction include reception of a print job from the printer interface 102.

When the sleep restoration control unit detects the occurrence of the restore instruction during the monitoring period (ACT 13: YES), ACT 1 is performed.

When the sleep restoration control unit does not detect the occurrence of the restore instruction during the monitoring period (ACT 13: NO), ACT 12 is performed.

In ACT 12 which is performed after ACT 13, the image forming apparatus 100 has already entered the sleep mode. For this reason, specifically, a present condition is maintained without performing the sleep restoration control unit.

Next, a flow performed by ACT 14 after ACT 11 will be described.

In ACT 14, the control unit 60 determines whether the power source switch 50 is turned off.

When the power source switch 50 is not turned off (ACT 14: NO), ACT 2 is performed.

When the power source switch 50 is turned off (ACT 14: YES), ACT 15 is performed.

In ACT 15, the control unit 60 resets the number of prints m in the job counter 61*a* and the number of prints n in the combined job counter 61*b* to 0.

ACT 16 is performed after ACT 15.

In ACT 16, the control unit 60 resets the printing completion time t0 in the storage unit 63 to 0.

When ACT 16 is completed, operation of the power source switch 50 becomes effective. The power source 51 is turned off.

As described above, in the image forming apparatus 100, whether continuously executed print jobs are a combined job is determined. In the case of the combined job, the combined job counter 61*b* counts the number of prints n over a plurality of print jobs. Furthermore, the control unit 60 calculates the number of remaining prints nr from the number of prints m using the job counter 61*a*.

The control unit 60 drives the fan motor 41 when the number of prints n and the number of remaining prints nr satisfy the condition: n>Nf and nr>Na (hereinafter, referred to as the condition X). The condition X can be experimentally obtained in advance as a condition in which the operating environment temperature of the polygon motor 44 exceeds an allowable value. Furthermore, the condition X is set by considering temperature rise due to all of a plurality of print jobs which can be regarded as a combined job. For this reason, even when the plurality of print jobs are performed in various patterns, it is possible to reliably detect the cooling start timing of the polygon motor 44 without using a temperature sensor or the like. In the image forming apparatus 100, it is possible to reliably keep the operating environment temperature of the polygon motor 44 lower than or equal to the allowable value.

In contrast, the control unit 60 stops the fan motor 41 when the number of prints n and the number of remaining prints nr do not satisfy the above-described condition X, that is, when the number of prints n and the number of remaining prints nr satisfy the condition: $n \leq Nf$ or $nr \leq Na$ (hereinafter, referred to as the condition Y) which is a negation of the condition X.

The condition Y is a condition in which the operating environment temperature of the polygon motor 44 becomes less than or equal to an allowable value only by natural cooling. For this reason, the fan motor 41 is stopped except for when cooling is required, depending on the use state of the image forming apparatus 100.

For this reason, the fan motor 41 is efficiently driven. As a result, power consumption and noise of the image forming apparatus 100 is reduced.

Hereinafter, a modification example of the above-described embodiment will be described.

In the image forming apparatus 100 of the above-described embodiment, the polygon motor 44 is cooled by the fan motor 41. However, the cooling object using the fan motor is not limited to the polygon motor 44. For example, the fan motor of the image forming apparatus 100 may cool other heating components in which heat generation is increased in accordance with the number of prints.

For example, when the laser scanning unit 26 has a light deflector other than the polygon motor 44, the light deflector may be set to a cooling object.

For example, when the image forming apparatus uses a solid scanning type optical scanning device using an LED instead of the laser scanning unit 26, the optical scanning device may be set to a cooling object. In this case, the fan motor performs cooling by blowing air to a radiation member of the LED.

Any cooling control method in any case can employ the same cooling control method as that in the above-described embodiment.

In the image forming apparatus 100 of the above-described embodiment, the condition X is $n>Nf$ and $nr>Na$. However, the condition X may be simply set to only $n>Nf$.

In the above-described embodiment, the numerical examples such as the first threshold value T, the second threshold value Nf, the allowable number of remaining sheets Na, and the allowable value of the operating environment temperature of the polygon motor are merely an example in the embodiment. These numerical values can be changed depending on the configuration of the image forming apparatus.

In the image forming apparatus 100 of the above-described embodiment, the case where the printing speed is 50 sheets/minute was described as an example. If the printing speed varies, a first threshold value and a second threshold value are set in accordance with the relationship between the driving time of a heating component and the operation time of a printer portion.

In the image forming apparatus 100 of the above-described embodiment, an example of the case where the counter 61 counts the number of prints as a value which is replaced with the operation time of the printer portion 3 was described. However, the value which is replaced with the operation time of the printer portion 3 is not limited to the number of prints. For example, the counter 61 may count the driving time of a heating component or the operation time of a printer portion. For example, the counter 61 may count the rotation amount, the rotation time, or the like of the photoconductive drum, the polygon motor, or the like. For example, the counter 61 may count the driving time of an LED or the like when performing a LED solid scanning.

According to at least the one embodiment described above, the image forming apparatus has a printer portion, a fan motor, a counter, a timer, and a control unit. The control unit of the image forming apparatus resets the counter when the time interval of a print job measured by the timer exceeds a first threshold value. Furthermore, the control unit starts driving of the fan motor when an operation time, such as the number of prints, of the printer portion which is counted by the counter or a value replaced with the operation time of the printer portion is greater than or equal to a second threshold value which is previously set. For this reason, the control unit can detect the timing at which it is necessary to cool the image forming apparatus, without using a temperature sensor. The control unit can drive the fan motor when it is necessary to cool the image forming apparatus. It is possible to reliably cool the image forming apparatus while reducing power consumption and noise due to the fan motor.

What is claimed is:

1. An image forming apparatus comprising:

a printer portion which forms an image on a sheet based on an input print job;

a fan motor;

a counter which counts an operation time of the printer portion or a value which is replaced with the operation time of the printer portion;

a timer which measures a printing start time and a printing completion time based on the print job; and a control unit which controls the fan motor, wherein the control unit calculates a time interval between print jobs from the difference between a printing completion time of a first print job and a printing start time of a second print job based on the value which is measured by the timer when the print jobs are continuously performed, wherein the control unit resets the counter when the time interval exceeds a first threshold value, and wherein the control unit starts driving of the fan motor when the operation time which is counted by the counter or the value thereof is greater than or equal to a second threshold value.

2. The apparatus according to claim 1, wherein the value is the number of prints in terms of printing a single face of the sheet.

3. The apparatus according to claim 2, wherein the control unit calculates the number of remaining prints in the print job from a printing number setting value included in the print job and the number of prints counted by the counter, and wherein the control unit does not drive the fan motor even if the number of prints during execution of the print job exceeds the second threshold value if the number of remaining prints is less than or equal to the allowable number of prints which is previously set.

4. The apparatus according to claim 1, wherein the printer portion includes a polygon motor, and wherein the fan motor cools the polygon motor.

5. The apparatus according to claim 1, wherein the control unit stops the fan motor after the print job which is being executed is completed when driving of the fan motor is started.

6. The apparatus according to claim 1, wherein the value of the counter is reset when a power source is turned off.

7. The apparatus according to claim 1, further comprising:

a storage unit which stores the start time and the completion time which are measured by the timer, wherein the completion time stored in the storage unit is reset when a power source is turned off.

8. The apparatus according to claim 1, wherein the first threshold value is 30 minutes.

9. The apparatus according to claim 1, wherein the second threshold value is 3000 sheets (in terms of A4 sheet for transverse feeding).

10. A cooling control method for an image forming apparatus, comprising:

cooling a printer portion which forms an image on a sheet based on an input print job, using a fan motor;

counting an operation time of the printer portion or a value which is replaced with the operation time of the printer portion;

calculating a time interval between print jobs when the print jobs are continuously performed by the printer portion;

resetting the counter if the calculated time interval exceeds a first threshold value; and starting driving of the fan motor when the counted operation time or the counted value is greater than or equal to a second threshold value.

* * * * *